US008474234B2

(12) United States Patent
Cassanmagnago

(10) Patent No.: US 8,474,234 B2
(45) Date of Patent: Jul. 2, 2013

(54) MACHINE FOR MANUFACTURING STRANDS FROM WIRES

(75) Inventor: Marco Cassanmagnago, Castelli Calepio (IT)

(73) Assignee: Officine Meccaniche di Lesmo S.p.A., Lesmo (MB) (IT)

( * ) Notice: Subject to any disclaimer, the term of this patent is extended or adjusted under 35 U.S.C. 154(b) by 0 days.

(21) Appl. No.: 13/148,034

(22) PCT Filed: Feb. 15, 2010

(86) PCT No.: PCT/EP2010/051870

§ 371 (c)(1), (2), (4) Date: Sep. 16, 2011

(87) PCT Pub. No.: WO2010/094656

PCT Pub. Date: Aug. 26, 2010

(65) Prior Publication Data

US 2012/0001011 A1 Jan. 5, 2012

(30) Foreign Application Priority Data

Feb. 23, 2009 (IT) ..... MI2009A0248

(51) Int. Cl.
*D01H 7/24* (2006.01)

(52) U.S. Cl.
USPC ..... 57/71; 57/314

(58) Field of Classification Search
USPC ..... 57/67, 71, 314
See application file for complete search history.

(56) References Cited

U.S. PATENT DOCUMENTS

| | | | | |
|---|---|---|---|---|
| 2,817,948 | A | 12/1957 | Cook et al. | |
| 4,389,838 | A * | 6/1983 | Adelhard et al. | 57/71 |
| 6,141,948 | A * | 11/2000 | Brazeau | 57/58.65 |

FOREIGN PATENT DOCUMENTS

| | | |
|---|---|---|
| DE | 20016420 | 12/2000 |
| EP | 0732441 | 9/1996 |
| FR | 1384772 | 1/1965 |
| JP | 07003676 | 1/1995 |

OTHER PUBLICATIONS

PCT International Search Report for PCT/EP2010/051870 filed on Feb. 15, 2010 in the name of Officine Meccaniche Di Lesmo S.P.A.
PCT International Preliminary Report on Patentability for Feb. 15, 2010 in the name of Officine Meccaniche Di Lesmo S.P.A.
PCT Written Opinion for PCT/EP2010/051870 filed on Feb. 15, 2010 in the name of Officine Meccaniche Di Lesmo S.P.A.

* cited by examiner

*Primary Examiner* — Shaun R Hurley
(74) *Attorney, Agent, or Firm* — Steinfl & Bruno, LLP

(57) ABSTRACT

A machine for manufacturing strands from wires is disclosed. The machine comprises a first support for supporting a bobbin, wherein a rotor can rotate around a main axis for stranding wires and winding or unwinding around the main axis a strand or the like comprising these wires, while the first support can move along the main axis, which rotor is provided with a second support which rotates with the rotor around the main axis and can move along the main axis for supporting the bobbin, wherein the first support and/or the second support rotate the bobbin around the main axis when the rotor rotates around the main axis.

20 Claims, 6 Drawing Sheets

MACHINE FOR MANUFACTURING STRANDS FROM WIRES

CROSS REFERENCE TO RELATED APPLICATIONS

The present application is the US national stage of International Application PCT/EP2010/051870 filed on Feb. 15, 2010 which, in turn, claims priority to Italian Application MI2009A000248, filed on Feb. 23, 2009.

The present invention relates to a machine for manufacturing strands or the like, in particular a machine with a rotor which strands wires for manufacturing strands, cords, cables, ropes and the like, which are wound around a bobbin. Said machine can obviously be used inversely for unwinding strands or the like from a bobbin.

Known machines for manufacturing strands or the like comprise a support for supporting a bobbin, wherein a rotor can rotate around a main axis for stranding one or more wires and winding around the main axis, namely around the bobbin, a strand obtained by stranding these wires. The support of the bobbin can move along the main axis for obtaining an axial relative motion between the first support and at least one portion of the rotor, so as to uniformly distribute the strand around the bobbin. The support supports the bobbin from one side only, since a second support arranged on the opposite side and fixed to the first support would interfere with the rotation of the rotor and/or with the strand which is wound by the rotor around the bobbin. Since the bobbin is supported only from one side, big bobbins cannot be used and/or heavy strands cannot be wound. For overcoming this disadvantage the diameter of the point of the support which penetrates into the bobbin must be much greater (for example 200 mm) of the diameter (for example 80 mm) of the standard points, so that bulkier and non-standard bobbins must be used.

Other known machines comprise two supports which support the bobbin without moving it axially and a rotor provided with a pulley which transmits the strand from the rotor to the bobbin by moving along the rotor with an alternate motion in a direction parallel to the main axis, for uniformly distributing the strand around the bobbin. The rotor of said known machines is heavier and bulkier, since it must also comprise the mechanical and electrical means for moving said pulley, with a consequent increase of size, cost, electrical consumptions and risk of accidents or malfunctions. Furthermore, the feeding speed of the wires and the strand must be changed for compensating the movement of the pulley, with consequent problems of control and/or quality of the strand.

Further known machines comprise two supports which support the bobbin without moving it axially and a rotor which moves with an alternate motion in a direction parallel to the main axis, always for uniformly distribute the strand around the bobbin. These known machines have substantially the same disadvantages of said machines with translating pulley.

JP 07-003676 A, FR 1384772 and the first embodiment of EP 732441 A2 disclose machines comprising a longitudinal shaft which supports the bobbin, can move along the main axis and protrudes beyond the bobbin, thereby penetrating into a corresponding seat made in the rotor. U.S. Pat. No. 2,817,948 discloses a similar machine comprising a hollow longitudinal shaft which supports the bobbin, can move along the main axis and is provided with a longitudinal seat in which a further longitudinal shaft protruding from the rotor is arranged. In these four known machines the bobbin is pulled or pushed along the main axis only from the side opposite to the rotor, so that the control of the movement of the bobbin is relatively limited, with possible malfunctions especially when the bobbin is big and made heavy by the strand wound around it.

For overcoming the latter technical problem, the longitudinal shaft of the second embodiment of EP 732441 A2 protrudes beyond the rotor, so that both ends thereof can be simultaneously pulled or pushed by transmission members which are mutually connected by a longitudinal bar for being pushed or pulled along the main axis by a single motor. Said longitudinal shaft is interrupted where the bobbin is arranged, which bobbin is thus supported by the ends of the interrupted shaft. Said ends can be mutually fastened by a slidable connection rod which crosses the bobbin along the main axis. Since the bobbin must rotate around the main axis with a different speed with respect to the rotor, also said longitudinal shaft must rotate at a different speed with respect to the rotor. However, the second embodiment of EP 732441 A2 cannot work, since the portion of the longitudinal shaft arranged in the rotor interferes with the latter due to their different rotation speeds and to the pulley which takes the wires to be stranded from an axial cavity in the longitudinal shaft to the outside of the latter. In other words, the longitudinal shaft of the second embodiment of EP 732441 A2 could only rotate at the same speed of the rotor.

It is therefore an object of the present invention to provide a machine which is free from said disadvantages. Said object is achieved with a machine, whose main features are disclosed in the first claim, while other features are disclosed in the remaining claims.

Thanks to the particular second support of the bobbin, the machine according to the present invention can not only comprise a rotor which is relatively simple, light and less bulky, but can also support heavy bobbins and/or strands by using standard points.

The first and the second supports preferably support the bobbin in a rotatable manner, in particular by rotating the bobbin around the main axis without using a longitudinal shaft as in the prior art, and move along the main axis with an alternate motion, while the rotor rotates only around the main axis, so as to reduce the structural complexity of the machine and increasing its speed in the manufacture of strands.

The mutual distance between the two supports is preferably controlled and kept constant by a particular mechanical connection, so as to move axially also a heavy bobbin, while keeping it always in the correct position with respect to the rotor.

Further, the supports are preferably provided with particular mobile points for facilitating the mounting and the unmounting of the bobbins.

Thanks to its particular mechanical structure, the first support comprises all the means for rotating the bobbin, including the motor, so as to keep the bobbin always close to the first support and avoid a disadvantageous lever effect of the bobbin onto the first support, as instead happens in the second embodiment of EP 732441 A2.

According to a particular embodiment of the invention, the first support can move along the main axis in a manner independent from the second support, so as to easily mount and unmount bobbins having different widths.

Further advantages and features of the machine according to the present invention will become clear to those skilled in the art from the following detailed and non-limiting description of five embodiments thereof with reference to the attached drawings, wherein.

Figure 1:
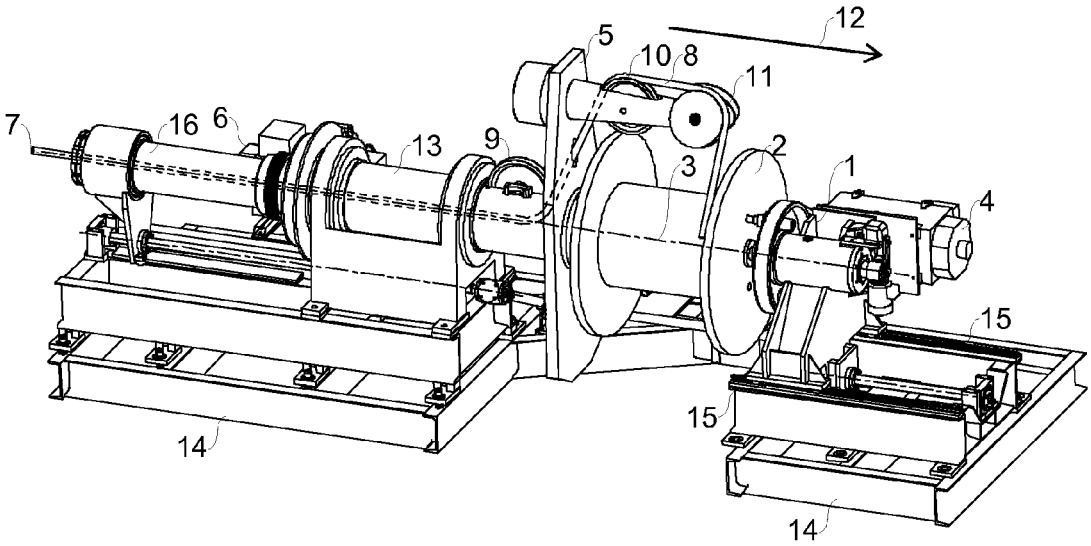
FIG. 1 shows a perspective view of the first embodiment of the machine in a first operating position.
Figure 2:
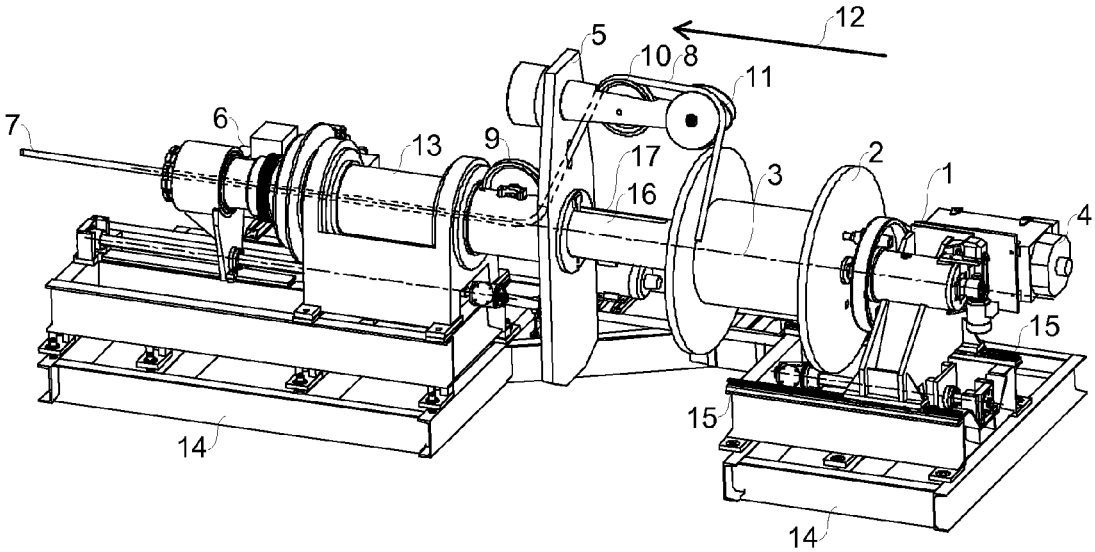
FIG. 2 shows the machine of FIG. 1 in a second operating position.
Figure 3:
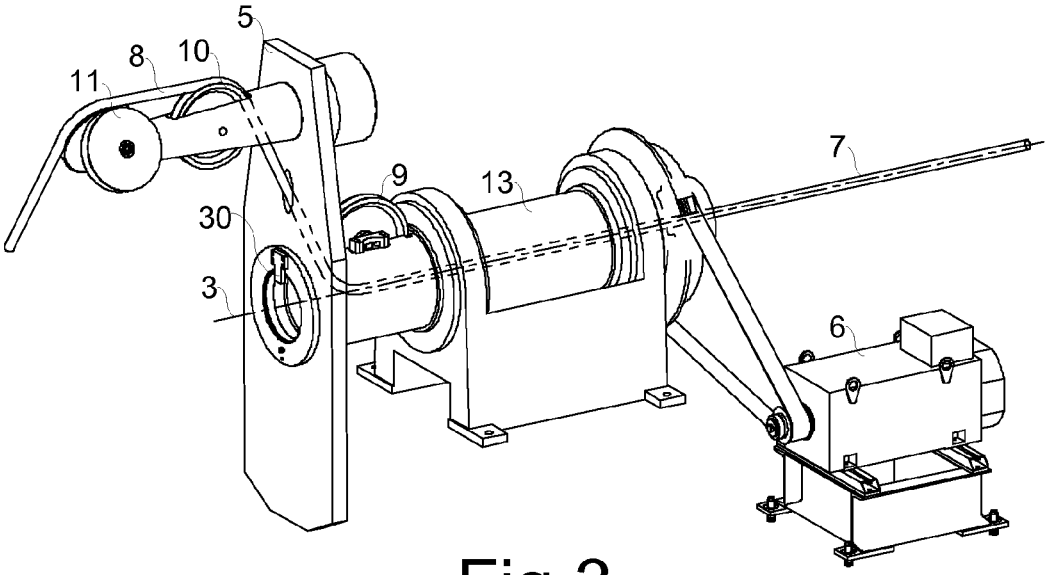
FIG. 3 shows the rotor of the machine of FIG. 1.

Referring to FIGS. 1 to 3, it is seen that the machine according to the first embodiment of the present invention comprises in a known way a first support 1 for supporting a bobbin 2 in a rotatable manner around a main axis 3, which is aligned with the longitudinal axis of bobbin 2. First support 1 is provided also with at least one first motor 4 for rotating bobbin 2 around main axis 3. A rotor 5 can rotate by means of a second motor 6 around main axis 3 for stranding one or more wires 7 and winding around main axis 3, namely around bobbin 2, a strand 8 obtained by stranding these wires 7. Rotor 5 is provided with a main pulley or roller 9 where wires 7 are stranded and with one or more secondary pulleys or rollers 10, 11 which guide strand 8 toward bobbin 2. Pulleys or rollers 9, 10, 11 can be substituted by other known means for guiding wires or strands.

First support 1 can move axially with an alternate movement (shown by arrow 12) along main axis 3 for uniformly distributing strand 8 around bobbin 2. In the present embodiment, rotor 5 is provided with a main body 13 which can rotate around main axis 3 thanks to second motor 6 but cannot move axially with respect to a fixed base 14. First support 1 can instead move along main axis 3 on one or more rails 15 of base 14. FIGS. 1 and 2 show first support 1 in two extreme operating positions.

Rotor 5 is provided with a second support 16 which can move along main axis 3 for supporting bobbin 2 in a rotatable manner around main axis 3, in such a position that bobbin 2 is arranged between first support 1 and second support 16. Second support 16 rotates with rotor 5 around main axis 3. First support 1 is mechanically connected to second support 16, so as to control the mutual distance between first support 1 and second support 16 during the rotation of rotor 5, in particular by controlling that this mutual distance is substantially constant. Second support 16 is arranged coaxially in main body 13 of rotor 5. Wires 7 get in from one end of second support 16 along main axis 3 and come out from a lateral opening 17 of second support 16 after they have been guided and stranded by main pulley or roller 9, which is pivoted to main body 13 for rotating both around its own axis and around main axis 3 in lateral opening 17. In particular, second support 16 has a substantially cylindrical shape, so as to balance its weight with respect to main axis 3. A tooth 30 fixed to rotor 4 protrudes in lateral opening 17 of second support 16 so that second support 16 rotates with rotor 5.

Figure 4:
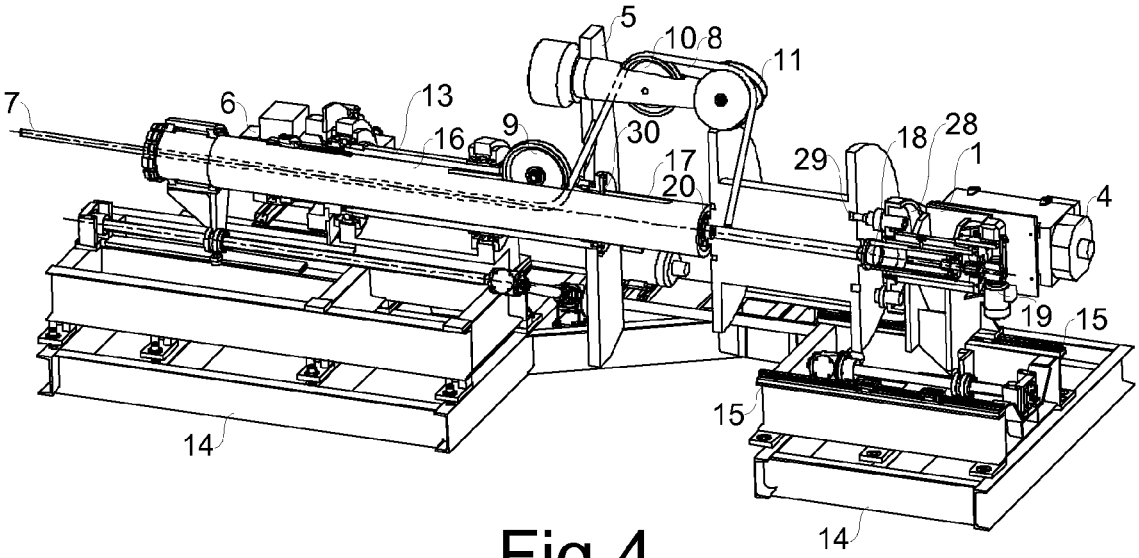
FIG. 4 shows the machine of FIG. 2 partially sectioned.

Referring to FIG. 4, it is seen that first support 1 is provided with a first point 18 which can penetrate into bobbin 2 for supporting in a rotatable manner a first side of bobbin 2. First point 18 can move with respect to first support 1 along main axis 3 by means of a third motor 19 for coupling bobbin 2 with first point 18. Second support 16 is provided with a second point 20 which can penetrate into bobbin 2 for supporting in a rotatable manner a second side of bobbin 2. In the present embodiment points 18 and 20 are idle, namely they can freely rotate with respect to first support 1 and second support 16, while first motor 4 rotates bobbin 2 around main axis 3 by means of a pulley 28 provided with a pin 29 which penetrates into an eccentric hole made on the first side of bobbin 2. In other embodiments, first point 18 can be mechanically connected to first motor 4 for rotating bobbin 2, while second point 20 is idle, or first point 18 can be idle and second point 20 can be driven by a motor for rotating bobbin 2 or both points 18, 20 can be driven by at least one motor. Alternatively or additionally, second point 20 can move with respect to second support 16 along main axis 3 with a mechanism similar to the one of first point 18.

For mounting bobbin 2 on supports 1, 16, the latter are moved axially so as to insert second point 20 into bobbin 2, after which first point 18 is moved axially in the opposite direction, so that first point 18 penetrates into bobbin 2, which results then centered between points 18, 20. For unmounting bobbin 2 the same operations are carried out inversely.

Figure 5:
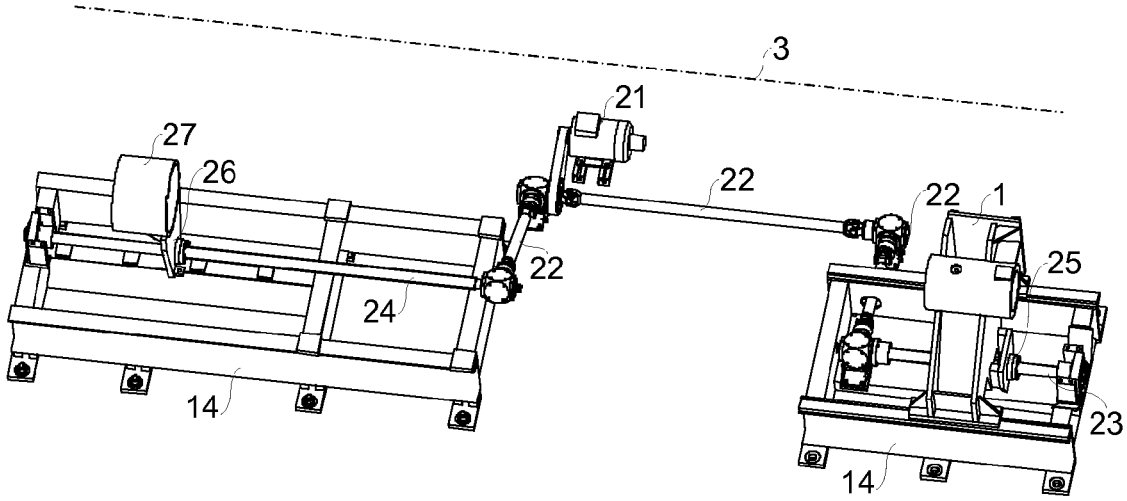
FIG. 5 shows the transmission system of the machine of FIG. 1.

Referring to FIG. 5, it is seen that the mechanical connection between first support 1 and second support 16 is carried out by means of at least one fourth motor 21 connected through a transmission 22 to one or more mobile members 23, 24, in particular two screws which can rotate with respect to base 14 around axes parallel to main axis 3. Said mobile members 23, 24 are mechanically coupled with first support 1 and second support 16 for moving these supports along main axis 3. In particular, the rotation of screws 23, 24 causes the axial movement of a first threaded sleeve 25 connected to first support 1 and of a second threaded sleeve 26 connected to second support 16 through a rotatable support 27, respectively.

Figure 6:
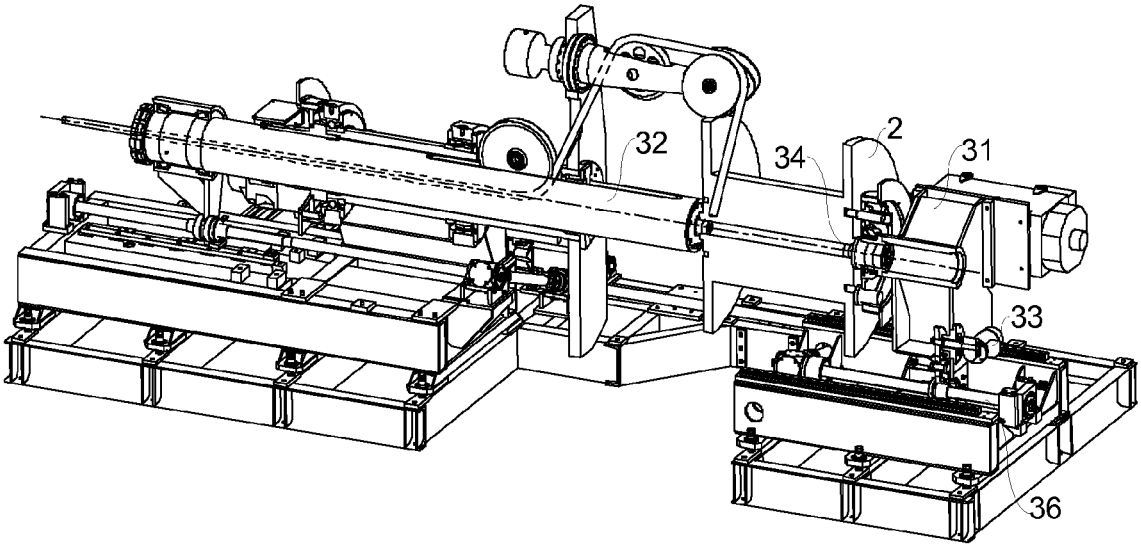
FIG. 6 shows a perspective view partially sectioned of the second embodiment of the machine.
Figure 7:
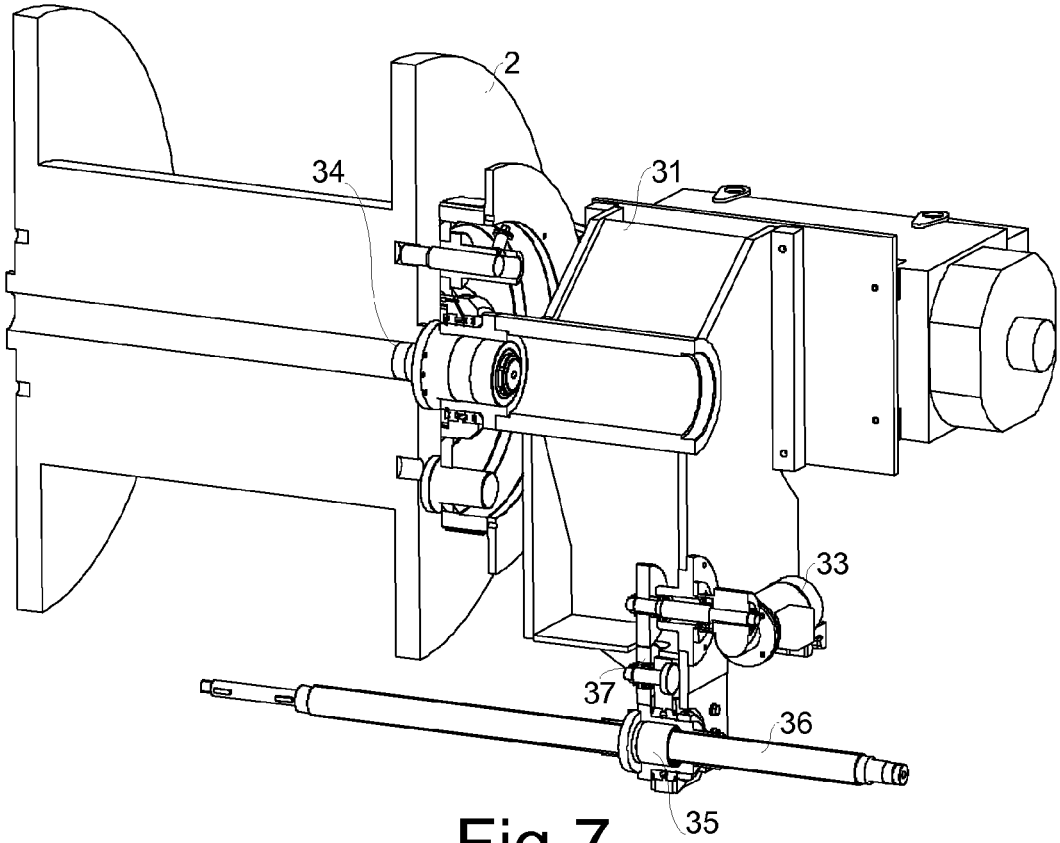
FIG. 7 shows an enlarged and partial view of the machine of FIG. 6.

Referring to FIGS. 6 and 7, it is seen that the first and the second embodiments of the machine according to the present invention are substantially the same, however first support 31 can move with respect to second support 32 thanks to a motor 33 which, instead of moving first point 34 along main axis 3, rotates first threaded sleeve 35 of first support 31 around screw 36 by means of a transmission 37. With this arrangement, the mutual distance between first support 31 and second support 32 can be changed, in particular during the mounting and unmounting of bobbin 2. During the working of the machine, however, threaded sleeve 35 is stopped, so that the distance between first support 31 and second support 32 remains substantially constant during the rotation of the rotor. Alternatively or additionally, the second support can be provided with a motor for rotating its threaded sleeve, so as to move as first support 31.

Figure 8:
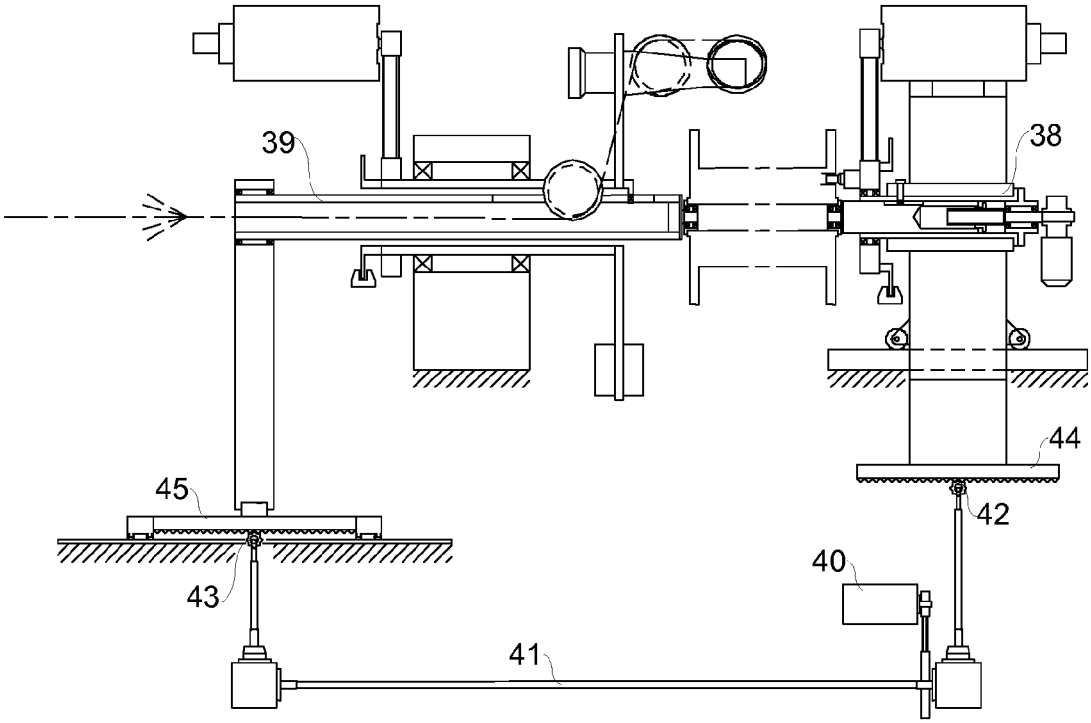
FIG. 8 shows a schematic view of the third embodiment of the machine.

Referring to FIG. 8, it is seen that the first and the third embodiments of the machine according to the present invention are substantially the same, however the mechanical connection between first support 38 and second support 39 is carried out by means of at least one fourth motor 40 connected through a transmission 41 to toothed wheels 42, 43 engaged with two racks 44, 45 which are substantially parallel to main axis 3 and are fastened to first support 38 and second support 39, respectively. In an alternative embodiment, toothed wheels 42, 43 are connected to two motors for moving first support 38 independently from second support 39.

Figure 9:
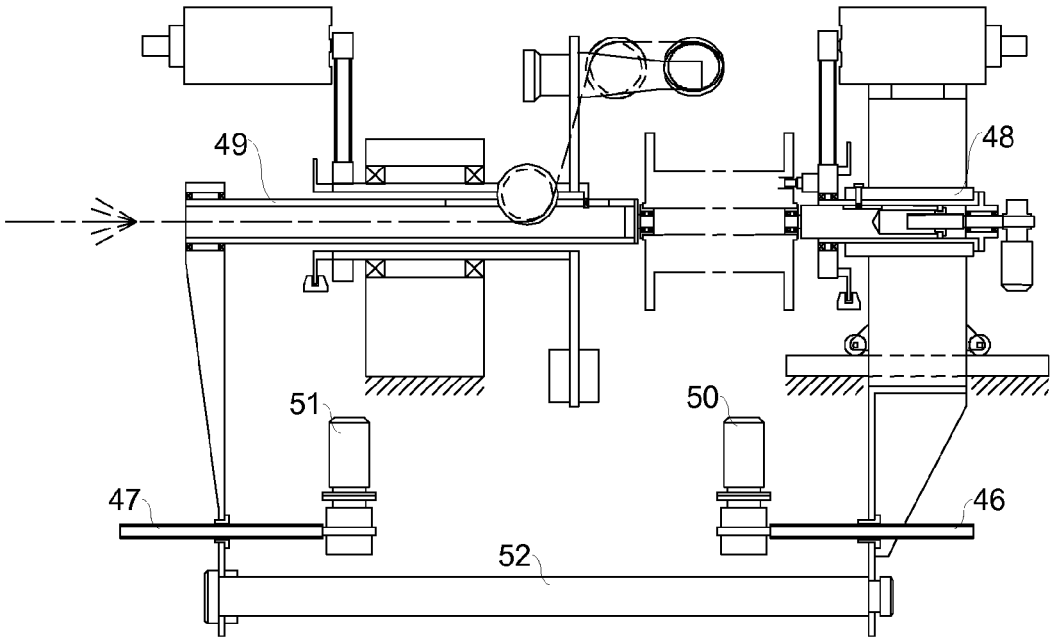
FIG. 9 shows a schematic view of the fourth embodiment of the machine.

Referring to FIG. 9, it is seen that the first and the fourth embodiments of the machine according to the present invention are substantially the same, however screws 46, 47 which move first support 48 and second support 49, respectively, are rotated by two motors 50, 51, respectively, controlled by an electronic system (not shown in the figure). A safety rod 52 may however be fixed between first support 48 and second support 49 for keeping their mutual distance substantially constant during the rotation of the rotor, also in case of a malfunction of either motor 50, 51.

Figure 10:
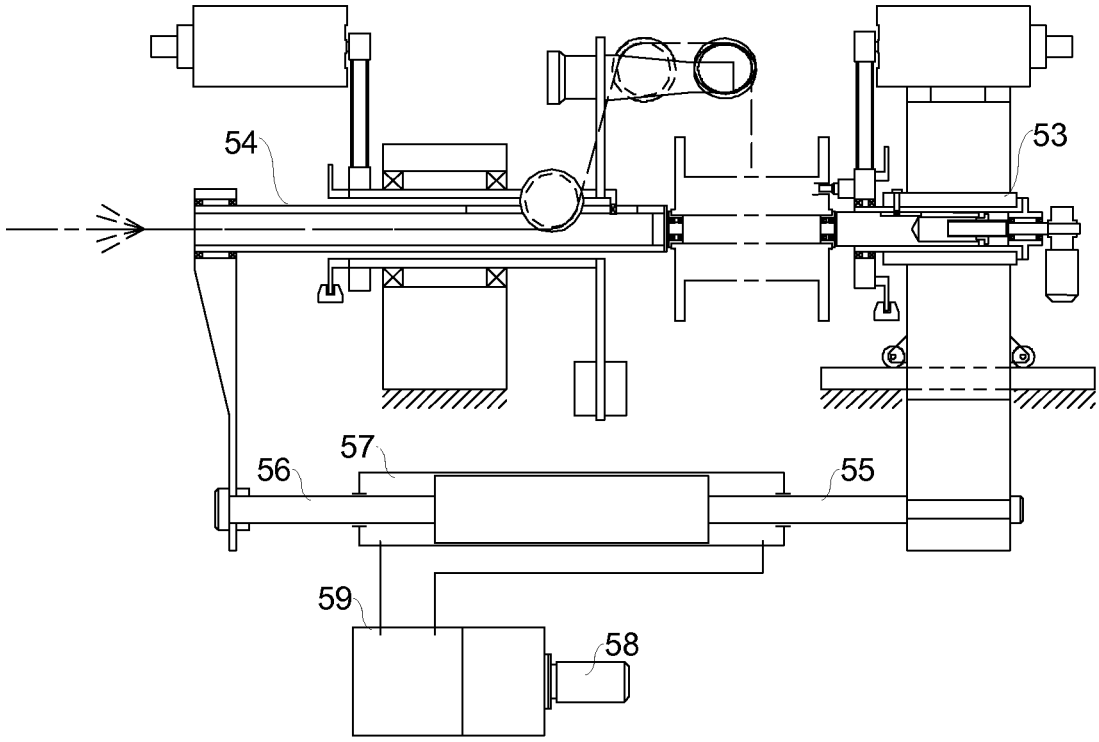
FIG. 10 shows a schematic view of the fifth embodiment of the machine.

Referring to FIG. 10, it is seen that the first and the fifth embodiments of the machine according to the present invention are substantially the same, however the mechanical connection between first support 53 and second support 54 is carried out by means of two opposing pistons 55, 56 arranged substantially parallel to main axis 3 in at least one cylinder 57 for being simultaneously driven by a motor 58 by means of a hydraulic system 59. In an alternative embodiment, the pistons may be arranged in two separate cylinders for moving the first support and the second support in an independent manner with two motors and/or a different hydraulic system.

It is obvious that the machine according to the present invention can be used in an inverse manner, namely for unwinding a strand or the like from the bobbin, thereby stranding it for loosen the wires or taking it without torsions to another machine which rotates at the same speed.

Further modifications and/or additions may be made by those skilled in the art to the hereinabove disclosed and illustrated embodiments while remaining within the scope of the following claims.

The invention claimed is:

1. A machine, comprising a first support for supporting a bobbin, wherein a rotor is adapted to rotate around a main axis for stranding wires and for winding or unwinding around the main axis, a strand, a cord, a cable or a rope comprising these wires, wherein the rotor is provided with a second support which is adapted to move along said main axis for supporting the bobbin between the first support and the second support, wherein at least the first support is adapted to rotate the bobbin around the main axis when the rotor rotates around the main axis, wherein the second support is adapted to rotate with the rotor around the main axis, and wherein the first support is adapted to move along the main axis together with at least one motor which is mounted on the first support and is adapted to rotate the bobbin around the main axis.

2. The machine according to the claim 1, wherein said motor rotates the bobbin around the main axis by means of a pulley provided with a pin adapted to penetrate into an eccentric hole made on a side of the bobbin.

3. The machine according to claim 1, wherein the first support and the second support are provided with a first point and a second point, respectively, which are adapted to support the bobbin and are adapted to rotate around the main axis with respect to the first support or to the second support.

4. The machine according to claim 3, wherein the first point and/or the second point are adapted to move along the main axis with respect to the first support or to the second support, respectively.

5. The machine according to claim 3, wherein the first point and/or the second point are idle.

6. The machine according to claim 1, wherein the first support is mechanically connected to the second support, so as to control the distance between the first support and the second support.

7. The machine according to claim 1, wherein the first support and/or the second are mechanically connected to at least one motor for moving the first support and/or the second support along the main axis.

8. The machine according to claim 7, wherein the first support and/or the second support are mechanically connected to at least one further motor for moving the first support and/or the second support along the main axis with respect to the second support or the first support, respectively.

9. The machine according to claim 1, wherein the first support and the second support are driven by at least one motor connected to one or more mobile members mechanically coupled with the first support and/or the second support.

10. The machine according to claim 9, wherein said mobile members comprise one or more screws, each screw being adapted to rotate around an axies parallel to the main axis, wherein the rotation of the screws causes the axial movement of a first threaded sleeve connected to the first support and of a second threaded sleeve connected to the second support, respectively.

11. The machine according claim 10, wherein at least one threaded sleeve is mechanically connected to at least one motor for moving the first support and/or the second support along the main axis.

12. The machine according to claim 9, wherein said mobile members comprise toothed wheels engaged with two racks which are substantially parallel to the main axis and are fastened to the first support and to the second support, respectively.

13. The machine according to claim 9, wherein said mobile members comprise two pistons arranged substantially parallel to the main axis in at least one cylinder for being driven by at least one motor by means of a hydraulic system.

14. The machine according to claim 1, wherein the second support is provided with means adapted to guide the wires from an end of the second support along the main axis to and come out or get in from a lateral opening of the second support or in the opposite direction.

15. The machine according to claim 14, wherein a tooth fixed to the rotor protrudes in the lateral opening of the second support so that the second support rotates with the rotor.

16. The machine according to claim 14, wherein said means adapted to guide the wires include a pulley or roller which is pivoted to the main body of the rotor for rotating both around its own axis and around the main axis in the lateral opening.

17. The machine according to claim 15 wherein said means adapted to guide the wires include a pulley or roller which is pivoted to the main body of the rotor for rotating both around its own axis and around the main axis in the lateral opening.

18. The machine according to claim 9, wherein the second support is provided with means adapted to guide the wires from an end of the second support along the main axis to and come out or get in from a lateral opening of the second support or in the opposite direction.

19. The machine according to claim 18, wherein a tooth fixed to the rotor protrudes in the lateral opening of the second support so that the second support rotates with the rotor.

20. The machine according to claim 18, wherein said means adapted to guide the wires include a pulley or roller which is pivoted to the main body of the rotor for rotating both around its own axis and around the main axis in the lateral opening.

* * * * *

UNITED STATES PATENT AND TRADEMARK OFFICE

CERTIFICATE OF CORRECTION

PATENT NO. : 8,474,234 B2
APPLICATION NO. : 13/148034
DATED : July 2, 2013
INVENTOR(S) : Marco Cassanmagnago It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 16 days.

Signed and Sealed this
Eighth Day of September, 2015

Michelle K. Lee

Michelle K. Lee
*Director of the United States Patent and Trademark Office*